US005167299A

United States Patent [19]

Nusbaum

[11] Patent Number: 5,167,299

[45] Date of Patent: Dec. 1, 1992

[54] SAFETY NET ARRANGEMENT FOR BUILDING ELEVATOR SHAFTS

[76] Inventor: Arthur Nusbaum, 1500 Palisade Ave., Fort Lee, N.J. 07024

[21] Appl. No.: 789,660

[22] Filed: Nov. 8, 1991

[51] Int. Cl.[5] ..... E04G 21/32

[52] U.S. Cl. ..... 182/138

[58] Field of Search ..... 182/137, 138, 139, 140

[56] References Cited

U.S. PATENT DOCUMENTS 271,429 1/1883 Davis ..... 182/137

896,213 8/1908 Kerfoot ..... 182/138

FOREIGN PATENT DOCUMENTS 608311 1/1935 Fed. Rep. of Germany ..... 182/138

322068 12/1989 Japan ..... 182/138

*Primary Examiner*—Reinaldo P. Machado

*Attorney, Agent, or Firm*—Kirschstein, Ottinger, Israel & Schiffmiller

[57] ABSTRACT

A net is yieldably supported in an elevator shaft to permit a controller, decelerated descent of an object falling down the shaft. The net is automatically closed and maintained in a closed state by closure rings that slide along tethers attached to the net.

18 Claims, 2 Drawing Sheets

FIG. 6
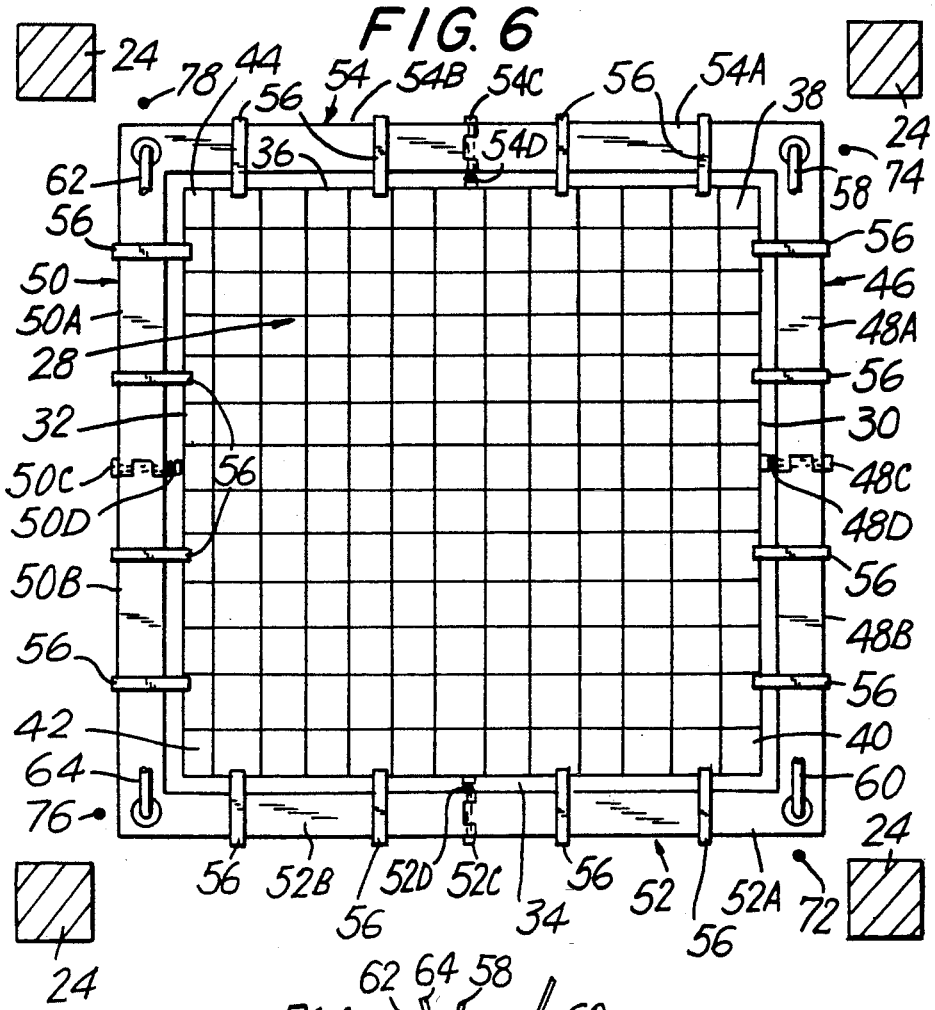
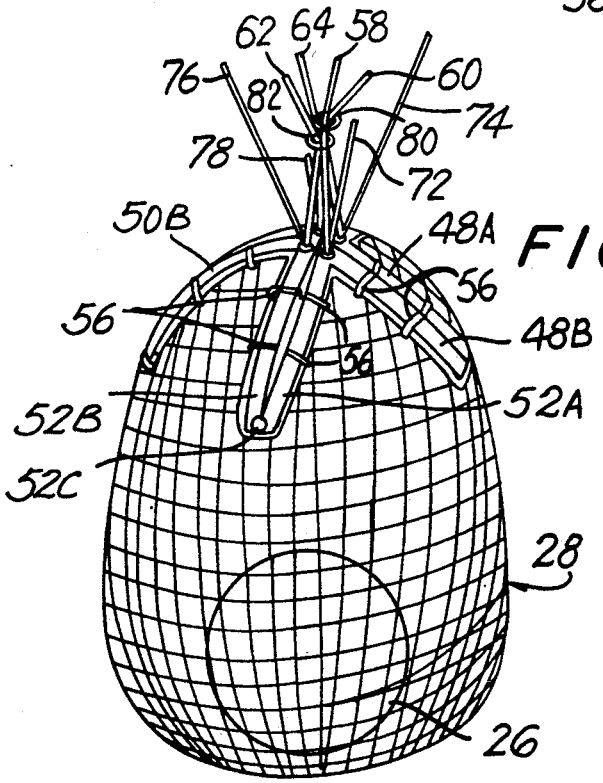
FIG. 7

SAFETY NET ARRANGEMENT FOR BUILDING ELEVATOR SHAFTS

BACKGROUND OF THE INVENTION

1. Field of the Invention

This invention generally relates to a safety net arrangement for catching objects falling down open shafts and, more particularly, to catching workers and/or items encountered at a construction site falling down elevator shafts or like open passages in multi-floor buildings under construction.

2. Description of Related Art

During the construction of a multi-floor building having elevators, it is known to position metal or wood decks, or even steel beams, directly over an elevator shaft in order to protect workers from falling down the shaft and/or to prevent construction materials or like items encountered at a construction site from being dropped, either accidentally or deliberately, down the elevator shaft. However, elevator workers requiring free access for the elevator cabin object to such blocking of the elevator shaft. Hence, the shaft is blocked at some times and unblocked at other times. The rigid covering of an elevator shaft, of course, provides no real crash protection for a worker who hits the rigid covering from an elevated height.

It is also known to position metal or wood railings around the elevator shaft in an attempt to deny access thereto. However, the installation of railings is a rather expensive and labor-intensive procedure which must be installed for each floor to be truly effective. Access to the shaft may also be blocked by ropes around the elevator shaft, but, here, again, the ropes need to be installed at each and every floor, and objects still pass over or under the ropes into the elevator shaft.

It is also known to tautly string a net at the top of an elevator shaft to protect ironworkers working on the top floor of a building. However, this does not protect workers entering the shaft at a lower floor and, in any event, some objects falling from an elevated height into a tautly strung net can generate enough force to actually tear and pass through the net, thereby providing no real crash protection at all.

SUMMARY OF THE INVENTION

1. Objects of the Invention

It is a general object of this invention to reliably catch objects, particularly workers, falling down an open shaft of a multi-floor building during construction.

It is another object of this invention to provide a controlled, decelerated descent for a falling object.

Another object of this invention is to protect falling workers during multi-floor building construction from injury and death.

A further object of this invention is to provide a safety net arrangement which is easy and inexpensive to install.

An additional object of this invention is to reduce building construction costs without sacrificing worker safety.

2. Features of the Invention

In keeping with these objects, and others which will become apparent hereinafter, one feature of this invention resides, briefly stated, in a safety net arrangement for catching objects falling down an open, upright shaft. The arrangement comprises a net mounted in the shaft at a predetermined elevation above the ground. The net extends transversely of the shaft across the path of an object falling down the shaft.

In accordance with this invention, means are provided for yieldably supporting the net from the shaft to permit a controlled decelerated descent of the object in the net to a lower elevation below said predetermined elevation, but still above the ground. The yieldable support for the net provides a "soft" catch or landing for the fallen object. The fallen object cannot crash through the net and impact on the ground.

In a preferred embodiment of this invention, the yieldable net supports include resilient, elongated tethers, each having an upper end connected to the shaft above the net, and an opposite lower end connected to the net. Preferably, there are two pairs of resilient tethers, each pair crossing over each other in a generally X-shaped orientation at cross-over junctions at opposite sides of the net. Each resilient tether is an elastic shock cord or webbing capable of being stretched to at least twice its unstretched length.

The arrangement further includes rigid cables, each having one end connected to the shaft above the net, and an opposite end connected to the net. Each rigid cable has an excess length which hangs below the net when the net is at said predetermined elevation. Preferably, there are two pairs of rigid cables arranged in mutual parallelism. Each rigid cable is a steel, non-stretchable cord which serves as an end-limiting stop for the descent of the object. Each steel cord may be padded.

The net is normally held open in an open position across the shaft. This may be advantageously achieved by a one-piece or multi-piece frame.

During the descent of the object, means are provided for automatically closing the net to a closed position, and for maintaining the net in said closed position. More particularly, a closure member surrounds each cross-over junction. The closure member may advantageously be a split, steel ring encircling each cross-over junction. The ring slides downwardly along the resilient tethers during descent of the object.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is an enlarged top plan view taken on line 6—6 of FIG. 1; and FIG. 7 is an enlarged, broken-away, perspective view of the net in the closed position.

DETAILED DESCRIPTION OF THE PREFERRED EMBODIMENTS

Figures 1, 2, 3, 4, 5:
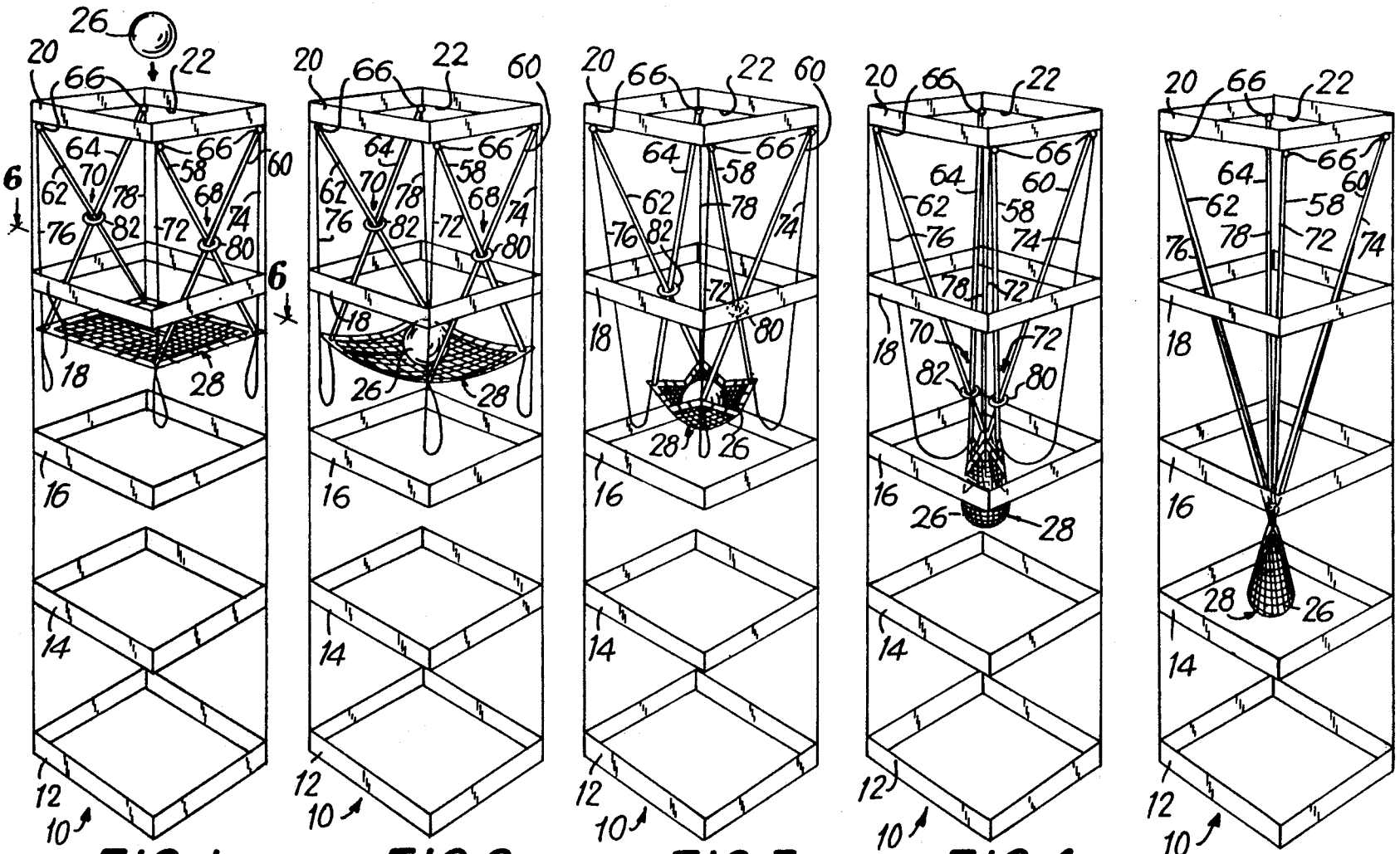
FIG. 1 is a perspective view of a safety net arrangement mounted in an open building shaft, showing the net in an open position ready to receive a falling object.
FIG. 2 is analogous to FIG. 1, but showing the net at an initial stage of catching the object.
FIG. 3 is analogous to FIG. 2, but showing the net at a subsequent stage of catching the object.
FIG. 4 is analogous to FIG. 3, but showing the net at a later stage of catching the object.
FIG. 5 is analogous to FIG. 4, but showing the net in a closed position in which the object has been snared.

Referring now to the drawings, reference numeral 10 generally identifies a multi-floor building under construction, and includes, by way of example, floors 12, 14, 16, 18, 20 in ascending order. This invention is not intended to be limited to the use of safety net arrangements in buildings of only five floors, since the invention is equally well applicable to multi-floor buildings having fewer or more than five floors.

Building 10 has an open, upright shaft 22, typically an elevator shaft bounded by walls or columns 24 (see FIG. 6). It will further be understood that this invention is not intended to be limited to elevator shafts, but is equally well applicable to air-conditioning conduits, electrical closets, plumbing pipes, exhaust ducts, or, in short, any elongated, vertical passage. In addition, this invention is not limited solely to buildings, but could, for example, equally apply to mine shafts or earth tunnels.

This invention relates to a safety net arrangement for automatically catching an object 26 falling down the shaft 22. Although the object 26 has been illustrated in the drawings as having a ball shape, this was done merely for convenience of illustration. It will be understood that the object to be caught may be animate or inanimate and, indeed, in the preferred embodiment, the object is a worker. The object may also be construction materials and like items commonly found at a construction site. As best shown in FIG. 6, the arrangement includes a net 28 preferably constituted of an open-work netting material, but could also be a closed webbing such as a cargo net. The net 28 may have any shape, but, as illustrated, has a quadrilateral shape with two longitudinal peripheral edges 30, 32 and two transverse peripheral edges 34, 36. The net 28 has four corner regions 38, 40, 42, 44.

The net also includes a quadrilateral border frame 46 extending along the peripheral edges of the net. The frame 46 may be of one piece, or, as illustrated, of multi-piece construction. The frame 46 serves to maintain the net in an open position in which, as illustrated in FIG. 1, the net extends transversely of the shaft 22 across the path of the object 26. The net is mounted in the shaft at a predetermined elevation above the ground and, as illustrated, is mounted slightly below floor 18. The net may be mounted anywhere in the shaft below, above, or at, any floor.

The one-piece frame may be made of inherently resilient, synthetic plastic material strips which maintain the net in the open position, or, as illustrated, the frame may comprise frame elements pivotably connected to each other, and including coil springs for constantly urging the frame elements to the open position. Frame elements 48A, 48B are interconnected at pivot 48C and biased to a co-linear state by coil spring 48D; frame elements 50A, 50B are interconnected at pivot 50C and biased to a co-linear state by coil spring 50D; frame elements 52A, 52B are interconnected at pivot 52C and biased to a co-linear state by coil spring 52D; and frame elements 54A, 54B are interconnected at pivot 54C and biased to a co-linear state by coil spring 54D. Shackles 56 are used to attach the longitudinal and transverse edges of the net 28 to the frame elements 48A, 48B; 50A, 50B; 52A, 52B; and 54A, 54B.

The arrangement further includes means for yieldably supporting the net 28 from the shaft 22 to permit a controlled decelerated descent of the object 26 in the net to a lower elevation below said predetermined elevation, but still above the ground. The controlled descent is depicted in the consecutive views of FIGS. 2–5. In FIG. 5, which illustrates the closed position of the net in which the object 26 has been snared, the net is located between floors 14 and 16.

The yieldably supporting means includes two pairs of resilient elongated tethers 58,60; 62,64. Each tether has an upper end connected to the shaft above the net at eye-bolts 66 or analogous fastening devices, and an opposite lower end connected to the net. Preferably, each tether is mounted to a respective corner region 38, 40, 42, 44 of the net. The tethers of each pair cross over each other in a generally X-shaped orientation at cross-over junctions 68, 70.

Each tether is constituted as an elastic cord or webbing which preferably is capable of being stretched to at least twice its unstretched length. Such tethers are commonly known as bungee cords.

The arrangement further comprises two pairs of rigid cables 72,74; 76,78. Each rigid cable has one end connected to the shaft above the net, and preferably tied to the same eye-bolts 66 to which the tethers were attached, and an opposite end connected to the net, preferably at the corner regions 38, 40, 42, 44 thereof. Each rigid cable has an excess length which hangs below the net when the net is at said predetermined elevation (see FIG. 1).

All the rigid cables 72, 74, 76, 78 of excess length extend in mutual parallelism with one another, and are constituted of a non-stretchable steel cord or rope. The lengths of the rigid cables are identical and, as explained below, serve as end-limiting stops for the descent of the object.

The arrangement further comprises means for automatically closing the net to a closed position during descent of the object. The closing means includes a pair of closure members 80, 82 surrounding the crossover junctions 68, 70. Each closure member is a circumferentially-incomplete, or split, steel ring encircling the respective cross-over junction. Due to the X-shaped orientation of the resilient tethers 58,60; 62,64, the steel rings 80, 82 are held at the cross-over junctions above the net prior to catching the object. However, as the net descends due to impact with the falling object, the steel rings slide along the increasingly stretched tethers until they reach the net, thereby gathering together the four corner regions of the net (see FIG. 7).

In operation, the net is held in the open position as depicted in FIG. 1. When the object 26 initially impacts against the net, as depicted in FIG. 2, the entire net descends, thereby stretching the tethers in the process. The excess lengths of the rigid cables lose some slack. Thereupon, as depicted in FIG. 3, the process continues whereby the tethers are further stretched and additional slack in the rigid cables is taken up. As shown in FIG. 4, the corner regions of the net ensnare the object. FIG. 5 shows the net in the closed position in which the rigid cables have lost all their slack. The rigid cables, of course, prevent further descent of the ensnared object. As depicted in FIGS. 1–5, the closure rings 80, 82 slide downwardly toward the net and insure that the net remains closed. This is of particular benefit to insure that the object within the net does not rebound therefrom. The object caught in the net may now be pulled up or swung over to safety.

Other modifications are contemplated by this invention. For example, each resilient tether may be designed to break when it exceeds a certain limit. Thus, if the tethers break at or shortly before the limiting position of FIG. 5, this tends to reduce the chances that the safety net arrangement will swing wildly about the shaft.

For increased safety, each steel cord and steel ring is padded.

Alternatively, the one-piece frame mentioned above may likewise be designed to fracture and break at a threshold value during the descent of the object to the closed position. The threshold value may be on the order of 1500 foot-lbs., which is the force generated by a 150 pound worker falling ten feet. Hence, rather than merely relying on individual frame elements to pivot, it is sufficient for the safety net arrangement of this invention to cause its frame to break for the one-time capture of a fallen object. To prevent the fractured frame pieces from being exposed, a sleeve may surround the frame.

Of course, this invention is not intended to be limited to framed nets. The net can be held in the open position, even without a frame, for example, by being tied tautly to a floor. In this event, the net itself is constituted of an elastic material, such as elastic cord or webbing, as used in flexible cargo nets. Hence, the elastic composition of the safety net may constitute the means to yieldably support the net, as comprehended by the appended claims.

One or more such safety net arrangements can be provided in a shaft. In addition, tautly strung nets, typically used for debris collection, could be strung above the yieldably supported net of this invention. Thus, even if an object should tear and pass through the tautly strung net, the yieldably supported net of this invention serves as a convenient and effective back-up net for increased worker safety, not only for the falling worker, but for the other workers below the net who might be injured by the falling worker.

More than one yieldably supported net may be mounted in the shaft at convenient intervals.

It will be understood that each of the elements described above, or two or more together, also may find a useful application in other types of constructions differing from the types described above.

While the invention has been illustrated and described as embodied in a safety net arrangement for building elevator shafts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A safety net arrangement for catching objects falling down an open, upright shaft, comprising:

(a) a net mounted in the shaft at a predetermined elevation above the ground, said net extending transversely of the shaft across the path of an object falling down the shaft; and (b) means for yieldably supporting the net from an upper region of the shaft above the net, and for suspending the entire net below the upper region of the shaft to permit a controlled, decelerated descent of the object in the net to a lower elevation below said predetermined elevation, but still above the ground.

2. A safety net arrangement for catching objects falling down an open, upright shaft, comprising:

(a) a net having a periphery and being mounted in the shaft at a predetermined elevation above the ground, said net extending transversely of the shaft across the path of an object falling down the shaft; and (b) means for yieldably supporting the net from the shaft to permit a controlled, decelerated descent of the object in the net to a lower elevation below said predetermined elevation, but still above the ground, said yieldably supporting means including resilient, elongated tethers, each having an upper end connected to the shaft above the net, and an opposite, lower end connected to the periphery of the net.

3. The arrangement as recited in claim 2, wherein the net has four corner regions at the periphery, and wherein there are four resilient tethers, each connected to a respective corner region of the net.

4. The arrangement as recited in claim 3, wherein the four resilient tethers are arranged in two pairs, the resilient tethers of each pair crossing over each other in a generally X-shaped orientation.

5. The arrangement as recited in claim 2, wherein each resilient tether is an elastic shock cord or webbing.

6. The arrangement as recited in claim 5, wherein each elastic shock cord is capable of being stretched to at least twice its unstretched length.

7. A safety net arrangement for catching objects falling down an open, upright shaft, comprising:

(a) a net having a periphery and being mounted in the shaft at a predetermined elevation above the ground, said net extending transversely of the shaft across the path of an object falling down the shaft;

(b) means for yieldably supporting the net from the shaft to permit a controlled, decelerated descent of the object in the net to a lower elevation below said predetermined elevation, but still above the ground; and (c) rigid cables, each having one end connected to the shaft above the net, and an opposite end connected to the periphery of the net, each rigid cable having an excess length which hangs below the net when the net is at said predetermined elevation.

8. The arrangement as recited in claim 7, wherein the net has four corner regions at the periphery, and wherein there are four rigid cables, each connected to a respective corner region of the net.

9. The arrangement as recited in claim 8, wherein the four rigid cables are arranged in two pairs, the rigid cables of each pair extending generally parallel to each other.

10. The arrangement as recited in claim 7, wherein each rigid cable is a steel cord.

11. A safety net arrangement for catching objects falling down an open, upright shaft, comprising:

(a) a net mounted in the shaft at a predetermined elevation above the ground, said net extending transversely of the shaft across the path of an object falling down the shaft, said net including means for normally holding the net open in an open position across the shaft;

(b) means for yieldably supporting the net from the shaft to permit a controlled, decelerated descent of the object in the net to a lower elevation below said predetermined elevation, but still above the ground; and (c) means for automatically closing the net to a closed position during said descent of the object, and for maintaining the net in the closed position.

12. The arrangement as recited in claim 11, wherein the net has a periphery, and wherein the holding means includes a frame at the periphery.

13. The arrangement as recited in claim 12, wherein the frame includes border elements pivotably connected to each other, and biasing means for constantly urging the border elements to the open position.

14. The arrangement as recited in claim 11, wherein the net has a periphery, and wherein the yieldably supporting means includes at least one pair of resilient, elongated tethers, each having an upper end connected to the shaft above the net, and an opposite, lower end connected to the periphery of the net, the tethers of said one pair crossing over each other at a cross-over junction; and wherein the closing means includes a closure member surrounding the cross-over junction.

15. The arrangement as recited in claim 14, wherein the closure member is a circumferentially-incomplete ring.

16. A safety net arrangement for catching objects falling down an open, upright shaft of a multi-floor building under construction, comprising:

(a) a net mounted in the shaft at a predetermined elevation above the ground, said net being held open in an open position and extending transversely of the shaft across the path of an object falling down the shaft;

(b) means for yieldably supporting the net from the shaft to permit a controlled, decelerated descent of the object in the net to a lower elevation below said predetermined elevation, but still above the ground, including a plurality of resilient, elongated tethers, each having an upper end connected to the shaft above the net, and an opposite, lower end connected to the net;

(c) a plurality of rigid cables, each having one end connected to the shaft above the net, and an opposite end connected to the net, each rigid cable having an excess length which hangs below the net when the net is at said predetermined elevation; and (d) means for automatically closing the net to a closed position in which the net snares the fallen object during said descent.

17. The arrangement as recited in claim 16, wherein the net has opposite sides and corner regions; and wherein there are two pairs of resilient tethers and two pairs of rigid cables, the tethers of each pair of resilient tethers crossing over each other in space at cross-over junctions at opposite sides of the net, and the cables of each pair of cables being generally parallel to each other; and wherein each cable and tether is connected to respective corner regions of the net.

18. The arrangement as recited in claim 17, wherein the closing means includes a pair of rings respectively encircling the cross-over junctions and sliding downwardly along the tethers during said descent.

* * * * *